United States Patent [19]

Konomi

[11] 3,930,485

[45] Jan. 6, 1976

[54] APPARATUS FOR MIXING FUEL AND AIR FOR AN INTERNAL COMBUSTION

[75] Inventor: Toshiaki Konomi, Susono, Japan

[73] Assignee: Toyota Jidosha Kogyo Kabushiki Kaisha, Japan

[22] Filed: Dec. 5, 1973

[21] Appl. No.: 421,807

[30] Foreign Application Priority Data

July 24, 1973 Japan ..... 48-83472

[52] U.S. Cl. ..... 123/141; 48/180 R

[51] Int. Cl.[2] ..... F02M 29/04; F02M 29/14

[58] Field of Search ..... 123/141; 261/76, 79 R; 48/180 R, 180 M

[56] References Cited

UNITED STATES PATENTS

| | | | |
|---|---|---|---|
| 1,121,868 | 12/1914 | Riotte et al. | 123/141 |
| 1,951,812 | 3/1934 | Smith | 261/79 R |
| 2,090,673 | 8/1937 | Gombos | 123/141 X |
| 2,384,681 | 9/1945 | Janes | 123/141 |
| 3,633,342 | 1/1972 | Richardson | 261/76 X |

*Primary Examiner*—Charles J. Myhre
*Assistant Examiner*—Ira S. Lazarus
*Attorney, Agent, or Firm*—Stevens, Davis, Miller & Mosher

[57] ABSTRACT

Apparatus comprising a tubular housing connected to the suction pipe of a multi-cylinder internal combustion engine at one end and the intake manifold thereof at the other end, and a plurality of twisted blades positioned in the tubular housing along the axis thereof. The blades are adapted to impart a whirling motion to a mixture of fuel and air or of fuel, air and a recyclic portion of exhaust gas flowing through the tubular housing and reform it into a homogeneous mixture, without creating any appreciable resistance to the flow of the mixture.

3 Claims, 16 Drawing Figures

APPARATUS FOR MIXING FUEL AND AIR FOR AN INTERNAL COMBUSTION

This invention relates to an apparatus associated with a multi-cylinder internal combustion engine to produce a homogeneous mixture of fuel and air or fuel, air and a recyclic portion of exhaust gas for uniform distribution of fuel to all the cylinders.

Various devices are known in the prior art to produce a homogeneous mixture of fuel and air or of fuel, air and a recyclic portion of exhaust gases which is returned into the combustion chamber for reduction of harmful components in the exhaust gases. These prior art devices include, among others, a premix tube provided in the suction pipe of an engine, and a throat or throttle formed in the suction pipe. But the premix tube has been unacceptable as failing to provide a fuel-air mixture having a practically acceptable homogeneity. The throat or throttle has presented a disadvantage of undesirably increasing resistance to the flow of a fuel-air mixture through the suction pipe with a resultant lowering of engine performance.

It is, therefore, an object of this invention to provide an apparatus associated with a multi-cylinder internal combustion engine which can produce a homogeneous fuel-air mixture with a minimum resistance to the flow of the mixture and without appreciably impairing the engine performance.

It is another object of this invention to provide means having various configurations capable of mixing fuel and air very efficiently, while minimizing the resistance which they impart to the flow of a fuel-air mixture.

It is a further object of this invention to provide most effective arrangements of means for mixing fuel and air.

According to this invention, there is provided an apparatus comprising a tubular housing provided between the suction pipe of a multi-cylinder internal combustion engine for a motor vehicle or the like and the intake manifold thereof and a plurality of blade means having the same or different twisted configurations arranged within the tubular housing along the length thereof and adapted to impart a whirling motion to a mixture of fuel and air or fuel, air and a recyclic portion of exhaust gas flowing through the tubular housing into the intake manifold. The apparatus of this invention provides the following advantages, among others:

1. A mixture of fuel and air or fuel, air and a recyclic portion of exhaust gas can be reformed into a homogeneous one as it flows through the tubular housing and is given a whirling motion by the blade means. Therefore, fuel can be uniformly distributed to all the cylinders of an engine with which the apparatus is associated, so that combustion can be stabilized throughout the engine and the operating efficiency of a vehicle on which the engine is installed can be remarkably improved. Moreover, the homogeneous mixture of fuel and air produced by the apparatus reduces the carbon monoxide and hydrocarbon which are generated as fuel is burned, and also permits a satisfactory degree of combustion to take place at a smaller fuel-air ratio than has hitherto been necessary, so that considerable reduction in the consumption of fuel can be achieved.
2. Because of their unique twisted configurations, the blade means can impart a very smooth whirling motion to a fuel-air mixture, so that as it flows past the blade means, the fuel-air mixture is subjected to only an extremely smaller resistance than a baffle in a prior art device is known to create. Therefore, a homogeneous fuel-air mixture can be obtained without impairing the engine performance even during its operation at full load.
3. The apparatus of this invention can also provide a homogeneous mixture of fuel, air and a recyclic portion of engine exhaust gases. Therefore, combustion can be stabilized in an engine operating with a portion of its exhaust gases being recirculated thereinto, so that an improved operating efficiency of the vehicle can be obtained with a resultant reduction in the quantity of nitrogen oxide in the exhaust gases.

Other objects and advantages of this invention will become apparent from the following detailed description, and the accompanying drawings, in which.

Figure 1:
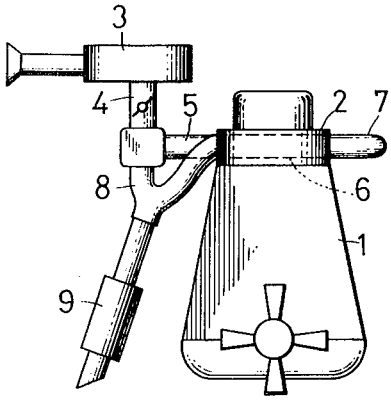
FIG. 1 is a front elevational view generally showing apparatus according to this invention associated with an intake and exhaust system for a vehicular engine.
Figure 3:
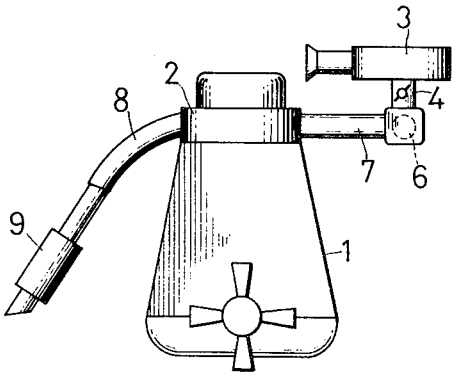
FIG. 3 is a front elevational view generally showing the apparatus of this invention associated with a different type of intake and exhaust system for a vehicular engine.
Figure 2:
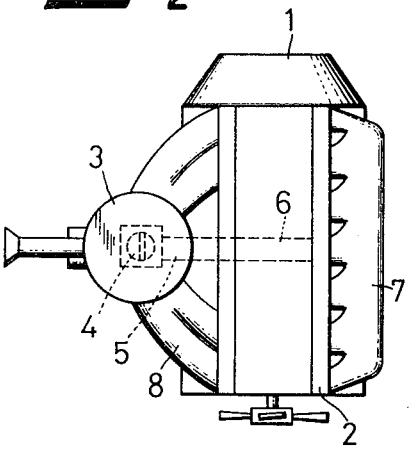
FIG. 2 is a top plan view of the arrangement shown in FIG. 1.
Figure 4:
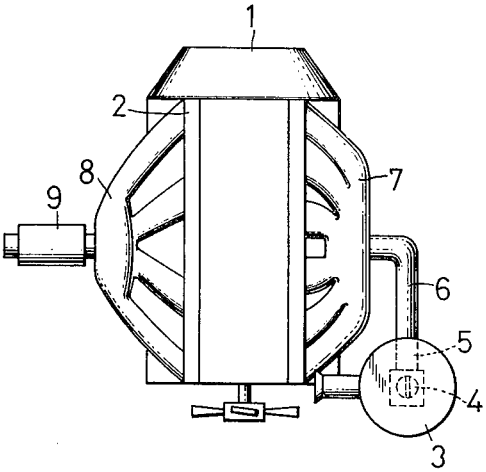
FIG. 4 is a top plan view of the arrangement shown in FIG. 3.

Referring now more particularly to FIGS. 1 to 4 of the drawings, there is rather schematically shown a cylinder block 1 associated with a plurality of cylinder heads 2, an air cleaner 3, a carburetor 4, a suction pipe 5, an intake manifold 7, an exhaust manifold 8 and an exhaust pipe 9 in a well known manner. The apparatus of this invention comprises a tubular housing 6 connected to the suction pipe 5 at one end and the intake manifold 7 at the other end. In one engine arrangement as shown in FIGS. 1 and 2, the tubular housing 6 extends between two adjacent cylinder heads 2 substantially along the transverse centerline of the cylinder block 1, while in another arrangement as shown in FIGS. 3 and 4, the tubular housing 6 is positioned aside from the cylinder heads 2 and extends in substantially parallel relation to the length of the cylinder block 1.

The tubular housing 6 encases a plurality of twisted blades arranged in succession along the length of the tubular housing 6. The blades may have various twisted configurations for the purpose of imparting a whirling motion to a mixture of fuel and air (and a recyclic portion of exhaust gas) flowing through the tubular housing 6 toward the intake manifold 7 to thereby reform it into a homogeneous mixture.

Various preferred forms of blades having different twisted shapes will be described with reference to FIGS. 7 through 12. Each of the various blades as described below is formed from a generally rectangular steel plate P having a predetermined length L and a width of $2r$, in which $r$ represents the radius of the bore of the tubular housing 6. The plate P has a front edge F, a rear edge R and a pair of side edges S, S. The side edges S, S are not straight, but are slightly curved outwardly for the reason which will become apparent from the following description.

Figure 5:
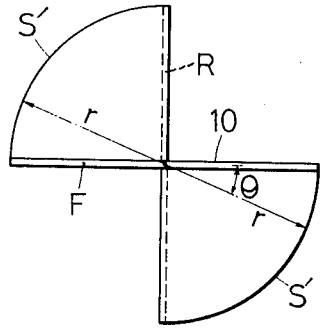
FIG. 5 is a top plan view of one form of blade means employed in the apparatus of this invention.
Figure 6:
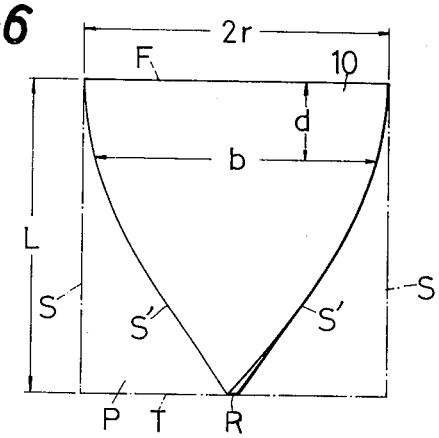
FIG. 6 is a front elevational view of the blade means shown in FIG. 5.

FIGS. 5 and 6 show one form of blade 10 which is formed by twisting the rear edge R of a plate P at right angles to the front edge F thereof. Referring to FIG. 6, the breadth of the blade 10 as measured between a pair of side edges S′, S′ is indicated as $b$ at a distance $d$ from the frong edge F, and referring to FIG. 5, the angle of twist of the blade 10 is indicated as $\theta$. The ratio of the distance $d$ to the angle $\theta$ is constant, and the following relationship exists:

$b = 2r \cos\theta$ in which $\theta$ is an angle between 0° and 90°. The opposite side edges S′, S′ of the blade 10 are shaped in the form of an arc having a radius equal to the radius $r$ of the tubular housing bore as viewed in top plan (FIG. 5), so that the side edges S′, S′ of the blade 10 may be brought into close contact with the inner peripheral surface of the housing 6 when the blade 10 is positioned in the housing 6.

Figure 7:
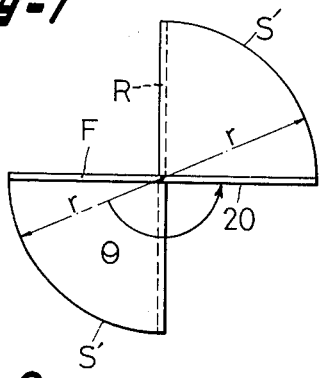
FIG. 7 is a top plan view of another form of blade means.
Figure 8:
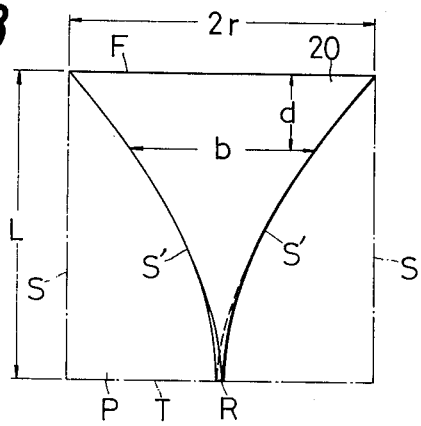
FIG. 8 is a front elevational view of the blade means shown in FIG. 7.

FIGS. 7 and 8 show a different form of blade 20 formed by twisting a plate P so that the following relationship may be established:

$$b = 2r(1 + \cos\theta)$$

in which $\theta$ is an angle between 90° and 180°. The opposite side edges S′, S′ of the blade 20 are each shaped in the form of an arc curved on the radius $r$ of the tubular housing bore as viewed in top plan (FIG. 7), and may be brought into close contact with the inner surface of the housing 6 when the blade 20 is positioned in the housing 6.

Figure 9:
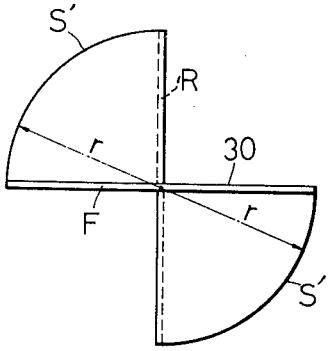
FIG. 9 is a top plan view of still another form of blade means.
Figure 10:
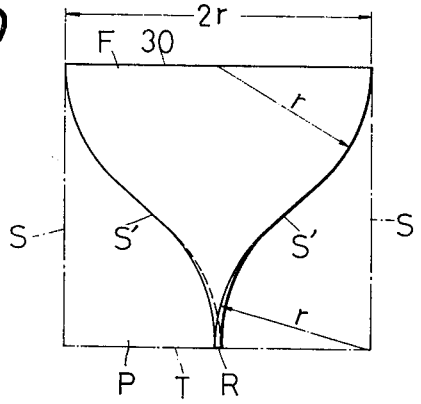
FIG. 10 is a front elevational view of the blade means shown in FIG. 9.

FIGS. 9 and 10 show still another form of blade 30. The blade 30 has a pair of opposite side edges S′, S′ each shaped in the form of an arc curved on the radius $r$ of the tubular housing bore as viewed in top plan (FIG. 9). A salient feature of the blade 30 lies in the contour of each side edge S′ as viewed in front elevation. As shown in FIG. 10, each side edge S′ has a contour composed of two successively connected arcs curved in the opposite directions on the radius $r$. The side edges S′, S′ of the blade 30 may also be brought into close contact with the inner surface of the tubular housing 6 when the blade 30 is fitted in the housing 6.

Figure 11:
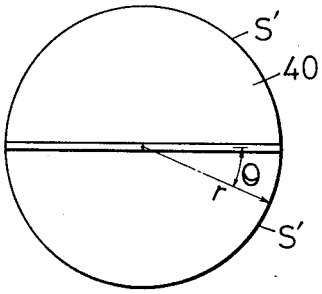
FIG. 11 is a top plan view of a further different form of blade means.
Figure 12:
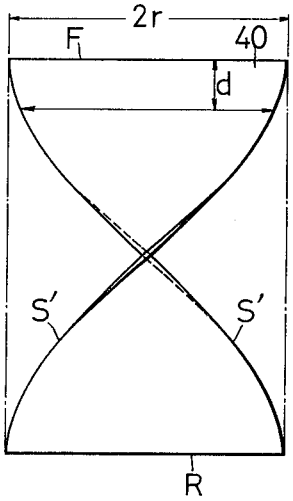
FIG. 12 is a front elevational view of the blade means shown in FIG. 11.

Referring to FIGS. 11 and 12, a further different form of blade 40 is formed by twisting the rear edge R of a similar, generally rectangular plate by 180° relative to the front edge F thereof in such a manner that the ratio of the distance $d$ to the angle $\theta$ may be constant, with the following relationship:

$b = 2r \cos\theta$ in which $\theta$ is an angle between 0° and 180°. The side edges S′, S′ of the blade 40 form a circle as viewed in top plan (FIG. 11), the circle having a radius equal to the radius $r$ of the tubular housing bore. As viewed in front elevation (FIG. 12), the side edges S′, S′ are each composed of two successively connected arcs and intersect each other. The side dges S′, S′ of the blade 40 may also be brought into close contact with the inner surface of the tubular housing 6 when the blade 40 is fitted in the housing 6.

Figure 13:
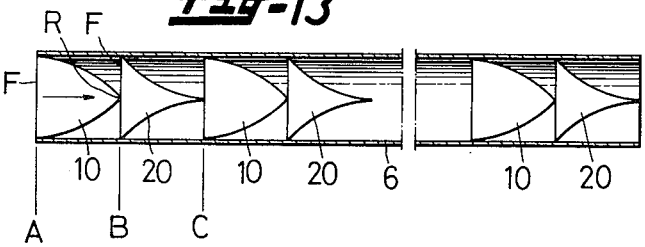
FIG. 13 is a fragmentary top plan view in longitudinal section of a tubular housing in which a plurality of blades shown in FIGs. 6 and 8 are arranged alternately.

Referring to FIG. 13, a plurality of blades 10 and 20 (blades of FIGS. 5–6 and 7–8) are arranged in the tubular housing 6 in alternate, closely adjacent relation. Each blade is welded to the inner surface of the housing 6 along its opposite side edges S′, S′. One blade 10 and an adjoining blade 20 are arranged so that the rear edge R of the blade 10 is positioned at right angles to the front edge F of the adjoining blade 20, but any other angular relationship may equally be employed in positioning the blades 10 and 20 in the housing 6. Blades 30 (FIGS. 9–10) and blades 40 (FIGS. 11–12) may be arranged and secured in the housing 6 in a similar manner, but when blades 30 or 40 are used, no blade of any other shape may need to be used in combination with blades 30 or 40.

In operation, air is sucked through the air cleaner 3 into the carburetor 4 and mixed with fuel. When the fuel is mixed with the air in the carburetor 4, a portion of the fuel is vaporized, but the remaining portion thereof is still in the state of liquid, so that fuel distribution in the fuel-air mixture obtained in the carburetor 4 is not uniform. In the arrangement shown in FIGS. 1 and 2, the fuel-air mixture is then preheated as it flows through the suction pipe 5 having a riser portion heated by the exhaust gas in the exhaust manifold 8, and is further heated as it enters the tubular housing 6 which is heated by the hot cooling water recirculating around the cylinder heads 2, so that the unvaporized fuel in the mixture is fully vaporized. The fully vaporized fuel is homogeneously mixed with air as it flows through the blades in the housing 6, and the homogeneous fuel-air mixture is uniformly distributed to all the cylinders through the intake manifold 7. In the arrangement shown in FIGS. 3 and 4, no such preheating of a fuel-air mixture takes place prior to its entrance to the tubular housing 6, but nevertheless, fuel is fully vaporized and homogeneously mixed with air by means of uniquely constructed blades as it flows through the tubular housing 6.

Figure 14:
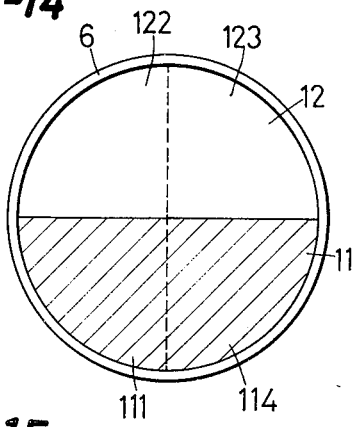
FIGS. 14, 15 and 16 illustrate progressively in a simplified pattern how a fuel-air mixture is whirled by the blade arrangement shown in FIG. 13 and reformed into a homogeneous one.
Figure 15:
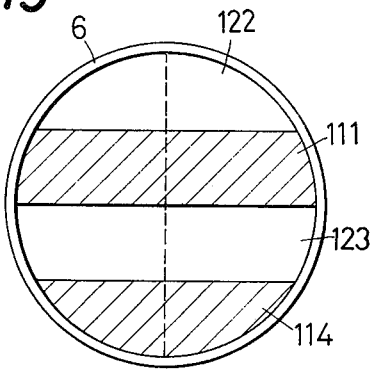
Figure 16:
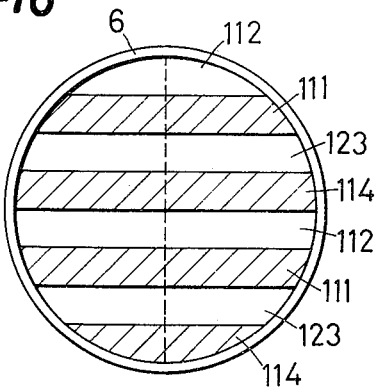

Referring to FIGS. 14 to 16, description will be made in further detail with respect to the function of the apparatus arranged as shown in FIG. 13. FIGS. 14 to 16 illustrate progressively in a simplified pattern a typical mode in which a fuel-air mixture is whirled and reformed into a homogeneous one as it flows through the blades 10 and 20 arranged in the housing 6 in alternating, closely adjacent relation. When it enters the housing 6 at position A in FIG. 13, the fuel-air mixture is divided into two portions, i.e., a lower portion 11 and an upper portion 12 by the front edge F of the first blade 10. As the mixture flows through the blade 10 in the direction of the arrow in FIG. 13, its lower and upper portions 11 and 12 are caused to flow clockwise (as viewed in FIG. 5) along the curved surfaces of the blade 10. For further discussion of the flow of the mixture in a most simplified pattern, let the lower and upper portions 11 and 12 be each subdivided into two smaller portions 111 and 114, and 122 and 123, respectively. As one of the smaller portions 114 flows clockwise (in FIG. 5 or 14) along an adjacent curved surface of the lower (in FIF. 5) portion of the blade 10, it urges an adjacent or second portion 111 to flow clockwise along an adjacent curved surface of the upper (in FIG. 5) portion of the blade 10 on the rear side thereof. Likewise, a third smaller portion 122 of the fuel-air mixture flows clockwise along the front side of the upper portion of the blade 10 and urges an adjacent or fourth portion 123 to flow clockwise, too, along the rear side of the lower portion of the blade 10. Thus, when the mixture leaves the rear edge R of the first blade 10 and enters the second blade 20 at position B in FIG. 13, the smaller portions 111, 114, 122 and 123 of the fuel-air mixture are envisaged to be arranged in an intermixed pattern substantially as shown in FIG. 15. As shown in FIG. 15, the portions 122 and 123 initially constituting the upper portion 12 of the mixture are arranged alternately with the portions 111 and 114 which initially constituted the lower portion 11 of the mixture, so that an initial intermixture of fuel and air is accomplished in the vicinity of position B in FIG. 13. The mixture thus obtained then flows through the blade 20 in a similar curved pattern, and when it leaves the second blade 20 and enters the third blade 10 at position C in FIG. 13, it is envisaged that the mixture is further subdivided into twice as many smaller portions as illustrated in FIG. 16 in a simplified pattern. In this way, further subdivision of the fuel-air mixture may continue through a series of blades until the mixture reaches the rear end of the housing 6, so that a homogeneous mixture of fuel and air is obtained at the rear end of the housing 6. It will be observed that the fuel-air mixture is subjected to subdivision and intermixing many times successively as it flows through the housing 6.

It is theoretically envisaged that the mixture which may be divided into only two portions at the entrance of the housing 6 may finally be subdivided into $2^{11}$ or 2,048 fractional portions at the exit of the housing 6 when the apparatus is provided with 10 blades, $2^{21}$ or approximately $2.1 \times 10^6$ fractional portions in case of a 20-blade apparatus and $2^{31}$ or approximately $2.15 \times 10^9$ fractional portions in case of 30 blades. Although these numbers are based on theoretical calculation and in practice there may be more or less deviation from the mixing patterns herein envisaged, the foregoing explanation based on theoretical data and patterns is believed to serve to describe how well the apparatus of this invention may intermix fuel and air to supply a homogeneous fuel-air mixture into the intake manifold. Because the ratio of the distance $d$ to the angle $\theta$ is constant with each blade 10 and 20, the initial upper and lower portions of the mixture entering each blade at its front edge are directed in opposite directions at an angle of approximately 45° relative to the front edge of the blade, and leave the blade. Since the blades 10 and 20 are arranged alternately with their curved portions directed in the opposite directions as shown in FIGS. 5 and 7, the flow of the mixture is directed in opposite directions through any two adjoining blades 10 and 20, so that the mixture may flow in a twisting course through the housing 6 and homogeneous intermixing of fuel and air may easily be achieved. Nevertheless, the curved surfaces of the blades 10 and 20 define such a smooth and continuous path for the twisting flow of the mixture that the blades do not create any appreciable amount of resistance to the flow of the mixture.

Referring to FIGS. 9 and 10, the blades 30 may create a somewhat greater resistance to the flow of the mixture than the combination of the blades 10 and 20 as hereinabove described. It should, however, be noted that insofar as the blades 30 are intended for use independently and not for use in combination with blades of any other shape, it is easier to manufacture the apparatus of this invention with blades 30 than with a combination of blades 10 and 20. The blade 30 is so shaped as to direct the flow of a fuel-air mixture substantially at right angles to the front of edge F thereof. It will be observed that since the blade 30 turns the flow of a fuel-air mixture at an angle about twice as large as the blade 10 or 20 does, it would be necessary to make it a little larger in depth than the blade 10 or 20 in order to maintain its resistance to the flow of the mixture at a reasonably small level.

The blade 40 shown in FIGS. 11 and 12 having its front and rear edges F and R in a common plane turns the flow of a fuel-air mixture substantially at an angle of 180° relative to the front edge F thereof without creating any appreciable resistance thereto.

It will be readily understood that the apparatus of this invention may equally be applied to an engine in which a portion of exhaust gas is recirculated for mixing with a fresh supply of fuel and air, and no detailed description of the apparatus for use in that particular situation would be necessary to those skilled in the art.

While the invention has been described in a few preferred forms, it should be understood that further modifications or variations may be made by those skilled in the art without departing from the scope of the invention which is defined by the appended claims.

What is claimed is:

1. In combination with a multi-cylinder internal combustion engine of the type having a carburetor, a suction pipe connected at one end to said carburetor, and an intake manifold, apparatus for supplying a homogeneous mixture of fuel and air into said intake manifold, said apparatus comprising:

a tubular housing, one end of said tubular housing being connected to the other end of said suction pipe and the other end of said tubular housing being connected to said intake manifold;

a plurality of first twisted blades positioned within said tubular housing along the length thereof; and a plurality of second twisted blades positioned within said tubular housing along the length thereof in an alternating, closely adjacent relationship to said first blades;

each of said first and second blades being formed from a generally rectangular plate of a predetermined length, and having a front edge and a rear edge the length of each of which is substantially equal to the inner diameter of said tubular housing, and having a pair of curved side edges secured to the inner surface of said tubular housing in close contact therewith;

the rear edge of each of said first blades being twisted at substantially a right angle to the front edge thereof in such a manner that the ratio of a distance between said front edge and an intermediate portion along the length of said plate as measured in front elevation to the angle of twist at said distance as measured in top plan is substantially constant throughout the length of said plate; and the rear edge of each of said second blades being twisted at substantially a right angle to the front edge thereof in such a manner that the relation between the breadth of said second blade as measured in front elevation at a distance between said front edge and an intermediate portion along said length of said plate and the angle of twist as measured in top plan at said distance may be expressed by the following formula:

$$b = 2r(1 + \cos\theta)$$

in which $b$ represents said breadth, $\theta$ represents the angle of twist and ranges between 90° and 180°, and $r$ represents one half the length of said front edge.

2. Apparatus as defined in claim 1, wherein each of said first and second blades is so positioned relative to another blade positioned immediately after said each blade and closer to said intake manifold that said rear edge of said each blade, except the last blade positioned closest to said intake manifold, is perpendicular to said front edge of said other blade.

3. In combination with a multi-cylinder internal combustion engine of the type having a carburetor, a suction pipe connected at one end to said carburetor, and an intake manifold, apparatus for supplying a homogeneous mixture of fuel and air into said intake manifold, said apparatus comprising:

a tubular housing, one end of said tubular housing being connected to the other end of said suction pipe and the other end of said tubular housing being connected to said intake manifold;

a plurality of twisted blades positioned within said housing in a closely adjacent relationship to one another;

each of said blades being formed from a generally rectangular plate, and having a front edge and a rear edge the length of each of which is substantially equal to the inner diameter of said tubular housing, and having a pair of curved side edges secured to the inner surface of said housing in close contact therewith;

the rear edge of each of said blades being twisted at substantially a right angle to the front edge thereof;

each of said side edges having a curved contour which includes two successively connected arcs curved in opposite directions on the inner radius of said housing; and each of said blades being so positioned relative to another blade positioned immediately after said each blade and closer to said intake manifold that said rear edge of said each blade, except the last blade positioned closest to said intake manifold, is connected to said front edge of said other blade in a substantially perpendicular relationship.

* * * * *